US008831179B2

(12) United States Patent
Adler et al.

(10) Patent No.: US 8,831,179 B2
(45) Date of Patent: Sep. 9, 2014

(54) X-RAY SOURCE WITH SELECTIVE BEAM REPOSITIONING

(75) Inventors: David L. Adler, San Jose, CA (US); Wenbing Yun, Walnut Creek, CA (US); Thomas Anthony Case, Walnut Creek, CA (US)

(73) Assignee: Carl Zeiss X-Ray Microscopy, Inc., Pleasanton, CA (US)

( * ) Notice: Subject to any disclaimer, the term of this patent is extended or adjusted under 35 U.S.C. 154(b) by 657 days.

(21) Appl. No.: 13/066,679

(22) Filed: Apr. 21, 2011

(65) Prior Publication Data

US 2012/0269324 A1 Oct. 25, 2012

(51) Int. Cl.

| | |
|---|---|
| ***H01J 35/02*** | (2006.01) |
| ***H01J 35/08*** | (2006.01) |
| ***H01J 35/14*** | (2006.01) |

(52) U.S. Cl.

CPC ..... *H01J 35/08* (2013.01); *H01J 2235/087* (2013.01); *H01J 35/14* (2013.01); *H01J 2235/186* (2013.01)

USPC ..... 378/143; 378/137; 378/138

(58) Field of Classification Search

CPC ..... H01J 35/08; H01J 35/14; H01J 35/24; H01J 35/30; H01J 2235/08; H01J 2235/084; H01J 2235/087; H01J 2235/088; H01J 2235/186; H01J 2235/064; H01J 2235/10; H05G 1/02; H05G 1/08; H05G 1/26; H05G 1/265; H05G 1/30; H05G 1/32; H05G 1/34; H05G 1/36; H05G 1/46; H05G 1/52

USPC ..... 378/109–113, 137, 138, 143

See application file for complete search history.

(56) References Cited

U.S. PATENT DOCUMENTS

| | | | | |
|---|---|---|---|---|
| 4,034,251 | A | | 7/1977 | Haas |
| 4,090,103 | A | | 5/1978 | Machenschalk et al. |
| 4,132,916 | A | | 1/1979 | Hueschen et al. |
| 4,600,659 | A | | 7/1986 | Hong et al. |
| 5,199,054 | A | * | 3/1993 | Adams et al. ..... 378/143 |
| 5,414,748 | A | | 5/1995 | Upadhya |
| 5,857,008 | A | * | 1/1999 | Reinhold ..... 378/137 |
| 6,282,263 | B1 | | 8/2001 | Arndt et al. |

(Continued)

FOREIGN PATENT DOCUMENTS

| | | | |
|---|---|---|---|
| EP | 1501339 | A1 | 1/2005 |
| JP | 2007134325 | A | 5/2007 |

(Continued)

*Primary Examiner* — Thomas R Artman

(74) *Attorney, Agent, or Firm* — Houston & Associates LLP

(57) ABSTRACT

During operation of an x-ray source, an electron source emits a beam of electrons. Moreover, a repositioning mechanism selectively repositions the beam of electrons on a surface of a target based on a feedback parameter, where a location of the beam of electrons on the surface of the target defines a spot size of x-rays output by the x-ray source. In response to receiving the beam of electrons, the target provides a transmission source of the x-rays. Furthermore, a beam-parameter detector provides the feedback parameter based on a physical characteristic associated with the beam of electrons and/or the x-rays output by the x-ray source. This physical characteristic may include: at least a portion of an optical spectrum emitted by the target, secondary electrons emitted by the target based on a cross-sectional shape of the beam of electrons; an intensity of the x-rays output by the target; and/or a current from the target.

18 Claims, 10 Drawing Sheets

(56) References Cited

U.S. PATENT DOCUMENTS

| | | | | |
|---|---|---|---|---|
| 6,456,690 | B2 | 9/2002 | Yamada et al. | |
| 6,595,821 | B2 | 7/2003 | Itoh et al. | |
| 6,661,876 | B2 | 12/2003 | Turner et al. | |
| 7,180,981 | B2 | 2/2007 | Wang | |
| 7,212,610 | B2 | 5/2007 | Ishikawa et al. | |
| 7,218,703 | B2 | 5/2007 | Yada et al. | |
| 7,346,148 | B2 * | 3/2008 | Ukita | 378/143 |
| 7,428,298 | B2 | 9/2008 | Bard et al. | |
| 7,983,394 | B2 * | 7/2011 | Kozaczek et al. | 378/138 |
| 8,416,920 | B2 * | 4/2013 | Okumura et al. | 378/143 |
| 2003/0021377 | A1 | 1/2003 | Turner et al. | |
| 2004/0091081 | A1 | 5/2004 | Frank | |
| 2005/0111624 | A1 | 5/2005 | Yada et al. | |
| 2005/0220266 | A1 | 10/2005 | Hirsch | |
| 2007/0025516 | A1 | 2/2007 | Bard et al. | |
| 2007/0110217 | A1 * | 5/2007 | Ukita | 378/141 |
| 2008/0069293 | A1 | 3/2008 | Lu et al. | |
| 2008/0089484 | A1 * | 4/2008 | Reinhold | 378/138 |
| 2010/0141151 | A1 | 6/2010 | Reinhold | |
| 2011/0058655 | A1 * | 3/2011 | Okumura et al. | 378/143 |
| 2012/0269323 | A1 * | 10/2012 | Adler et al. | 378/91 |
| 2012/0269324 | A1 * | 10/2012 | Adler | 378/138 |
| 2012/0269325 | A1 * | 10/2012 | Adler et al. | 378/138 |
| 2012/0269326 | A1 * | 10/2012 | Adler et al. | 378/138 |
| 2013/0195246 | A1 * | 8/2013 | Tamura et al. | 378/62 |

FOREIGN PATENT DOCUMENTS

| | | | |
|---|---|---|---|
| JP | 2008140687 | A | 6/2008 |
| WO | 2007012817 | A1 | 2/2007 |
| WO | 2008080624 | A1 | 7/2008 |
| WO | 2009121051 | A2 | 10/2009 |
| WO | 2011084146 | A1 | 7/2011 |

* cited by examiner

X-RAY SOURCE WITH SELECTIVE BEAM REPOSITIONING

FIELD OF THE INVENTION

The present disclosure relates generally to an x-ray source and associated methods. More specifically, the present disclosure relates to an x-ray source that selectively repositions a beam of focused electrons to different locations on a surface of a target based on a feedback parameter, which is based on a physical characteristic associated with the beam of electrons and/or the x-rays output by the x-ray source.

BACKGROUND

X-rays are widely used in micro-analysis and imaging because of their small wavelengths and their ability to penetrate objects. Imaging applications of x-ray sources include an x-ray imaging microscope and an x-ray point projection microscope. In an x-ray imaging microscope, a characteristic line of the x-ray source (i.e., monochromatic x-rays) is typically used with an x-ray lens (such as a Fresnel lens) to image an object. The resolution and aberrations associated with an x-ray imaging microscope are usually determined by the wavelength of the characteristic line.

In contrast, in an x-ray point projection microscope, a small x-ray source is used in conjunction with geometric magnification to image an object. Because an x-ray point projection microscope does not have aberrations, the resolution of an x-ray point projection microscope is typically determined by the size of the x-ray source. Ideally, the x-ray source would be a point source. In practice, the x-ray source is considerably larger. For example, if a tungsten wire is used to provide the x-rays, the x-ray-source size may be 50-200 μm; similarly, if a dispenser cathode (such as tungsten in a calcium-oxide mixture) is used to provide the x-rays, the x-ray-source size may be 1-5 mm. These x-ray-source sizes may limit the resolution of an x-ray point projection microscope.

Moreover, in these applications there is typically a tradeoff between the x-ray intensity and the operating life of the target or the x-ray intensity and the x-ray beam quality. In particular, as the electron-beam current (and, thus, the power consumption) in an x-ray source is increased, the cross-sectional diameter of the electron beam is also increased. This usually increases the cross-sectional diameter of the beam of x-rays output by the x-ray source. Furthermore, as the electron-beam current is increased, the operating life of the target is decreased because the degradation of the location on the target that is bombarded by the electrons is accelerated.

Therefore, there is a need for an x-ray source without the problems listed above.

SUMMARY OF THE INVENTION

One embodiment of the present invention provides an x-ray source. This x-ray source includes an electron source that emits a beam of electrons. Moreover, a repositioning mechanism selectively repositions the beam of electrons on a surface of a target based on a feedback parameter, where a location of the beam of electrons on the surface of the target defines a spot size of x-rays output by the x-ray source. Then, in response to receiving the beam of electrons, the target provides a transmission source of the x-rays. Furthermore, a beam-parameter detector provides the feedback parameter during operation of the x-ray source based on a physical characteristic associated with the beam of electrons and/or the x-rays output by the x-ray source.

Note that the beam-parameter detector may include: an optical detector, a secondary electron detector, a backscatter electron detector, an x-ray detector, and/or a current detector. Moreover, the physical characteristic may include: at least a portion of an infrared spectrum or a visible spectrum emitted by the target when it receives the beam of electrons; secondary electrons emitted by the target based on a cross-sectional shape of the beam of electrons; an intensity of the x-rays output by the target; and/or a current from the target.

Furthermore, the repositioning mechanism may scan the beam of electrons over the target, where the beam-parameter detector includes an image sensor and the physical characteristic includes an image of the target.

Additionally, the target may include features having a cross-sectional diameter, where the features facilitate focusing the beam of electrons to the spot size. For example, the repositioning mechanism may selectively reposition the beam of electrons towards one or more of the features based on a user input and/or the feedback parameter. Note that the features may include holes, defined by associated edges, in the target. These holes may be, at least in part, filled with a refractory material that is other than a material of the target surrounding the holes. Moreover, at least some of the holes may have different cross-sectional diameters and/or different thicknesses, thereby facilitating different spot sizes and different intensities of the x-rays output by the x-ray source depending on the location of the beam of electrons on the surface of the target.

In some embodiments, the features include protrusions fabricated on the surface of the target. These protrusions may include a refractory material other than a material of the target surrounding the protrusions. Moreover, at least some of the protrusions may have different cross-sectional diameters and/or different thicknesses, thereby facilitating different spot sizes and different intensities of the x-rays output by the x-ray source depending on the location of the beam of electrons on the surface of the target.

In some embodiments, the x-ray source includes a magnetic focusing lens that focuses the beam of electrons to a spot, having an initial spot size, on the target. In these embodiments, the feedback parameter may correspond to a difference between a cross-sectional diameter corresponding to the initial spot size of the focused beam of electrons and the cross-sectional diameter of the features so that, when focused by the magnetic focusing lens, the cross-sectional diameter corresponding to the spot size of the x-rays approximately equals the cross-sectional diameter.

Note that the spot size of the x-rays may be defined by the target independently of a cross-sectional shape of the beam of electrons received by the target.

Moreover, the target may include multiple layers in which at least one of the layers includes apertures that reduce the initial spot size associated with the beam of electrons to the spot size of the x-rays output by the x-ray source. For example, the multiple layers may include a first layer having an atomic number less than a predefined value, a second layer that includes the apertures, and a third layer having an atomic number greater than the predefined value. Furthermore, the repositioning mechanism may selectively reposition the beam of electrons towards one or more of the apertures.

Additionally, the x-ray source may passively define the spot size based on the location of the beam of electrons on the surface of the target.

In some embodiments, the repositioning mechanism selectively varies a focus of the beam of electrons on the target based on the feedback parameter. Alternatively or additionally, the repositioning mechanism may adjust a cross-sectional shape of the beam of electrons based on the feedback parameter.

Another embodiment provides a system that includes the x-ray source.

Another embodiment provides a method for providing the feedback parameter. During this method, the beam of electrons is emitted from the electron source. Then, the beam of electrons is selectively repositioned to different locations on the surface of the target using the repositioning mechanism based on the feedback parameter, where the location of the beam of electrons on the surface of the target defines the spot size of x-rays output by the x-ray source. In response to receiving the beam of electrons at the target, the transmission source of x-rays is provided. Moreover, during operation of the x-ray source, the feedback parameter is provided using the beam-parameter detector based on the physical characteristic associated with the beam of electrons and/or the x-rays output by the x-ray source.

Another embodiment provides an x-ray point projection microscope that includes the x-ray source.

Another embodiment provides a method for irradiating an object (such as food or a parcel) using the x-rays output by the x-ray source, thereby sterilizing the object.

Another embodiment provides a method for inspecting an object (such as an airplane, a train, a bridge, or in failure analysis of a machine that is susceptible to stress fractures or cracks) or reviewing features on the object (which may be identified via another technique) using the x-rays output by the x-ray source.

Another embodiment provides a method for imaging or irradiating at least a portion of an animal (such as a patient or a biological sample associated with the patient) using the x-rays output by the x-ray source, thereby performing a diagnostic test or implementing a medical therapy.

Another embodiment provides a method for writing patterns onto a semiconductor wafer, a photo-mask, a MEMS substrate, a substrate for an optical device, or another substrate material during a lithographic process using the x-rays output by the x-ray source.

BRIEF DESCRIPTION OF THE DRAWINGS

Note that like reference numerals refer to corresponding parts throughout the drawings. Moreover, multiple instances of the same part are designated by a common prefix separated from an instance number by a dash.

DETAILED DESCRIPTION

Embodiments of an x-ray source and associated methods are described. During operation of the x-ray source, an electron source emits a beam of electrons. Moreover, a repositioning mechanism selectively repositions the beam of electrons on a surface of a target based on a feedback parameter, where a location of the beam of electrons on the surface of the target defines a spot size of x-rays output by the x-ray source. In response to receiving the beam of electrons, the target provides a transmission source of the x-rays. Furthermore, a beam-parameter detector provides the feedback parameter based on a physical characteristic associated with the beam of electrons and/or the x-rays output by the x-ray source. This physical characteristic may include: at least a portion of an infrared spectrum or a visible spectrum emitted by the target when it receives the beam of electrons; secondary electrons emitted by the target based on a cross-sectional shape of the beam of electrons; an intensity of the x-rays output by the target; and/or a current from the target.

This x-ray source may have a small spot size, which facilitates high-resolution x-ray imaging, for example, in an x-ray point projection microscope. Moreover, the tradeoffs between x-ray intensity and an operating life of the target in the x-ray source or the x-ray intensity and x-ray beam quality may be improved or eliminated in the x-ray source. In particular, the x-ray source may be operated at higher electron-beam currents and, thus, higher x-ray intensity without increasing the cross-sectional diameter of the spot size of the x-rays output by the x-ray source. Furthermore, the higher x-ray intensity may not decrease the operating life of the target. More generally, at a given electron-beam current, the target in the x-ray source may have a significantly increased operating life relative to those in existing x-ray sources. In addition, the x-ray source may have a compact size and reduced weight, which may enable additional applications of the x-ray source (such as a hand-held or a portable version of the x-ray source). Consequently, the x-ray source may offer improved performance, which may result in enhanced commercial success.

Figure 1:
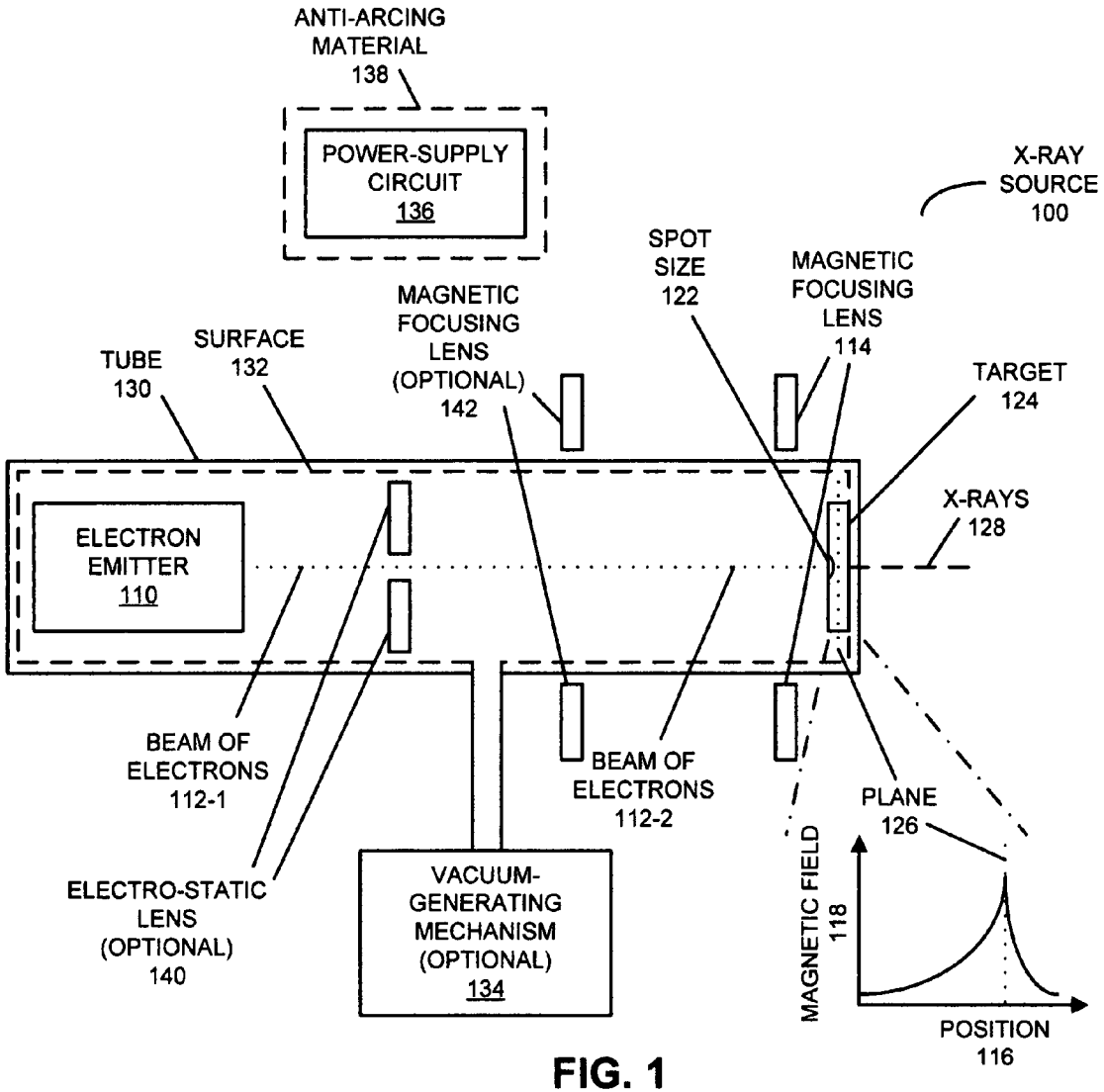
FIG. 1 is a block diagram of an x-ray source in accordance with an embodiment of the present disclosure.

We now describe embodiments of the x-ray source. FIG. 1 presents a block diagram of an x-ray source 100. This x-ray source includes an electron source, such as an electron emitter 110, which emits a beam of electrons 112-1 during operation. Moreover, x-ray source 100 may include a magnetic focusing lens 114 (with a pole piece having a permanent magnet with a high saturation magnet flux density) that focuses beam of electrons 112-1 to a spot, having a spot size 122 (or, equivalently, an area), on a target 124. For example, magnetic focusing lens 114 may include one or more coils (such as a quadrapole or octopole lenses, and, more generally, multi-pole coils) that, at least in part, generates a magnetic field that changes the shape or position of the spot. Note that target 124 may include: tungsten, tantalum, molybdenum, rhenium, copper, beryllium, and/or compounds that include two or more of these elements (which may include non-stoichiometric compounds). Furthermore, target 124 may be crystalline, polycrystalline or amorphous, and/or may include additional materials.

Magnetic focusing lens 114 may include an immersion lens in which a peak in a magnitude of a magnetic field 118 associated with magnetic focusing lens 114 as a function of position 116 occurs proximate to a plane 126 of target 124. (Therefore, in some embodiments magnetic focusing lens 114 is proximate to target 124.) Moreover, in response to receiving beam of focused electrons 112-2, target 124 provides a transmission source of x-rays 128. These x-rays may have a cross-sectional diameter corresponding to spot size 122.

X-ray source 100 may include a tube 130 that has a surface 132 that defines an interior of tube 130, and electron emitter 110 and target 124 may be included in the interior of tube 130. Moreover, tube 130 may be sealed and, at least during operation of x-ray source 100, optional internal vacuum-pumping elements, such as optional vacuum-generating mechanism 134 (such as an ion pump or sublimation pump, because these pumps do not exchange gas with the external environment), may reduce a pressure in the interior of tube 130 to less than atmospheric pressure, which is sometimes referred to as a 'reduced pressure.' (Note that a sealed tube typically is not actively pumped because it has a static vacuum, i.e., a sealed tube is pumped out during manufacturing and is sealed off from the external environment.) For example, the pressure in the interior of tube 130 may be less than or equal to high vacuum, i.e., approximately less than $10^{-4}$ Torr (such as $10^{-7}$ to $10^{-10}$ Torr). Furthermore, target 124 may include a thin-film deposited on surface 132 of tube 130, such as a 1-2 μm thick metal or beryllium film. Note that such a thin film may allow a higher geometric magnification in applications such as an x-ray point projection microscope.

In some embodiments, x-ray source 100 includes a power-supply circuit 136 that provides power to electron emitter 110 and magnetic focusing lens 114. Additionally, there may be an anti-arcing material 138 (such as standoffs) that surrounds power-supply circuit 136. Power-supply circuit 136 may be integrated into high-voltage electronics, which may reduce the size and weight of x-ray source 100 by 4-5× relative to existing x-ray sources, for example, to 1 $ft^3$ and 20 pounds.

In some embodiments, x-ray source 100 includes an optional electrostatic lens 140 between electron emitter 110 and magnetic focusing lens 114 that collimates beam of electrons 112-1. Alternatively or additionally, x-ray source 100 may optionally include another magnetic lens 142 configured to collimate beam of electrons 112-1.

In an exemplary embodiment, a focal length of magnetic focusing lens 114 may be between 0.5 and 5 mm, spot size 122 may have a cross-sectional diameter between 10 nm and 100 μm, and/or a focal length of optional electrostatic lens 140 may be between 0.5 and 50 mm. In some embodiments, spot size 122 may have a cross-sectional diameter between 10 nm and 10 μm or 1 and 5 μm. Thus, x-ray source 100 may be a nano-focus transmission x-ray source (i.e., spot size 122 may be much smaller than existing micro-focus x-ray sources). Moreover, electron emitter 112 may be a pointed source or a dispenser cathode.

Moreover, power-supply circuit 136 may output a voltage between 10 kV and 500 kV. In general, the power consumed by x-ray source 100 may be between 1 and 20 W, and the resulting electron current density may be between 1 and 50 $A/cm^2$. For example, for a voltage of 100 kV and a beam current of 100 μA, the power consumption is 10 W. This may result in spot size 122 having a cross-sectional diameter of 10 μm. (More generally, the cross-sectional diameter corresponding to spot size 122 may vary as 1 μm/W.) Additionally, tube 130 may be 4-5 inches long.

Note that electron emitter 110 may be selected based at least on two physical properties: it should emit electrons (and, more generally, charge carriers) when operated at the reduced pressure; and it should not evaporate or sublimate quickly under these conditions. The first physical property is determined by the work function of the electron-emitter material. The work function is the energy needed to liberate an electron from a surface. For a given material, the work function is typically a combination of bulk and surface properties. That is because many materials that are good emitters can easily become poor emitters depending on the vacuum conditions. Because the work function depends on the details of the very top monolayer of atoms on the surface of electron emitter 110, it can be difficult to predict, a priori, how a given material will behave. Note that the top layer of atoms can be the electron-emitter material, something adsorbed onto the surface, or an impurity from the bulk has segregated to the surface. Depending on the chemistry of the top few layers, these can either poison electron emission or improve it. As a practical matter, it is often necessary to measure the work function of an electron emitter under the conditions that it will be operated in order to know how well it will emit electrons.

The second of these physical properties determines the lifetime of electron emitter 110. If the bulk material evaporates quickly, as it does with tungsten or lanthanum hexaboride in an oxygen-containing environment (such as air or water vapor), then electron emitter 110 may either mechanically fail or may change its position within the optics of x-ray source 100. The former cannot be corrected. For example, if a tungsten wire in a so-called 'hairpin' configuration breaks, electron emitter 110 is dead. However, if electron emitter 110 has a so-called 'pointed-rod' configuration (or, more, generally, a 'pointed-source' configuration), then as the rod evaporates it grows shorter, changing the electric fields that extract the electrons. This change in geometry can be somewhat compensated by adjusting the extraction voltage. Lanthanum hexaboride and tungsten Schottky emitters fall into this latter category. Based on this discussion, to ensure a sufficient lifetime (such as up to 100,000 hours) at the reduced pressure, electron emitter 110 may have an evaporation or sublimation rate that is approximately the same as or less than that of tungsten or lanthanum hexaboride at the reduced pressure in the interior of tube 130.

Furthermore, a mounting or fixture (not shown) that holds electron emitter 110 may include a variety of construction materials. (For example, electron emitter 110 may be held by a carbon support structure, which in turn is mechanically and electrically coupled to molybdenum contacts. During operation of electron emitter 110, electrical current may be passed through the carbon support via the molybdenum contacts, thereby heating electron emitter 110.) In the present discussion, electron emitter 110 refers to a material or materials that emit the electrons for electron beam 112-1. In some embodiments, electron emitter 110 is a ceramic, such as a carbide-based material that has a low oxidation rate even at high temperatures and atmospheric pressure. The oxides of many carbide-based materials are not typically volatile, and therefore the evaporation or sublimation of electron emitter 110 may be reduced or eliminated when at the reduced pressure during the operation of x-ray source 100. In particular, the oxide typically forms a protective layer over the carbide-based material, thereby inhibiting further oxidation (thus, the oxide may be self-limiting). Consequently, carbide-based materials usually exhibit 'parabolic kinetics,' in which the oxide is self-passivating and grows more and more slowing with time (for example, varying as the square root of time).

Thus, in some embodiments electron emitter 110 has an evaporation or sublimation rate that is less than that of tungsten at the reduced pressure.

In some embodiments, electron emitter 110 is selected based on its melting temperature. This may allow electron emitter 110 to operate at a temperature and, thus, a higher beam current. Consequently, electron emitter 110, such as a ceramic or an oxide, may have a melting temperature greater than that of tungsten. For example, electron emitter 110 may include a bulk or thin-film outer coating of a refractory binary compound, such as: hafnium carbide (HfC), zirconium carbide, tantalum carbide, lanthanum hexaboride and/or compounds that include two or more of these elements (which may include non-stoichiometric compounds, such as $HfC_{0.98}$ or $HfC_{0.68}$). (However, in some embodiments, electron emitter 110 includes: hafnium dioxide, hafnium diboride, hafnium nitride, zirconium dioxide, zirconium diboride, tantalum diboride, tantalum nitride, rhenium, boron nitride, titanium carbide, niobium carbide, thorium dioxide, tungsten, lanthanum diboride, lanthanum hexaboride, a carbon nanotube, another allotrope of carbon, cerium hexaboride, and/or compounds that include two or more of these compounds.) This electron-emitter material may be crystalline, polycrystalline or amorphous, and/or may include additional materials, such as silicon dioxide, cerium oxide (which is sometimes referred to as 'ceria'), etc., to improve mechanical and/or electrical properties. If a thin-film outer coating is used, a wide variety of materials may be used for the substrate.

During the operation of x-ray source 100, electron emitter 110 may be heated above ambient temperature, may be cooled below ambient temperature or may be at approximately ambient temperature. Note that electron emitter 110 may operate in or close to a temperature-limited mode, as opposed to in a space-charge limited mode. Alternatively or additionally, electron emitter 110 may be a photo-emitter (in which electrons are emitted due to the photoelectric effect), a field emitter or a field-enhanced emitter, such as a Schottky emitter or a thermal field emitter.

Figure 2:
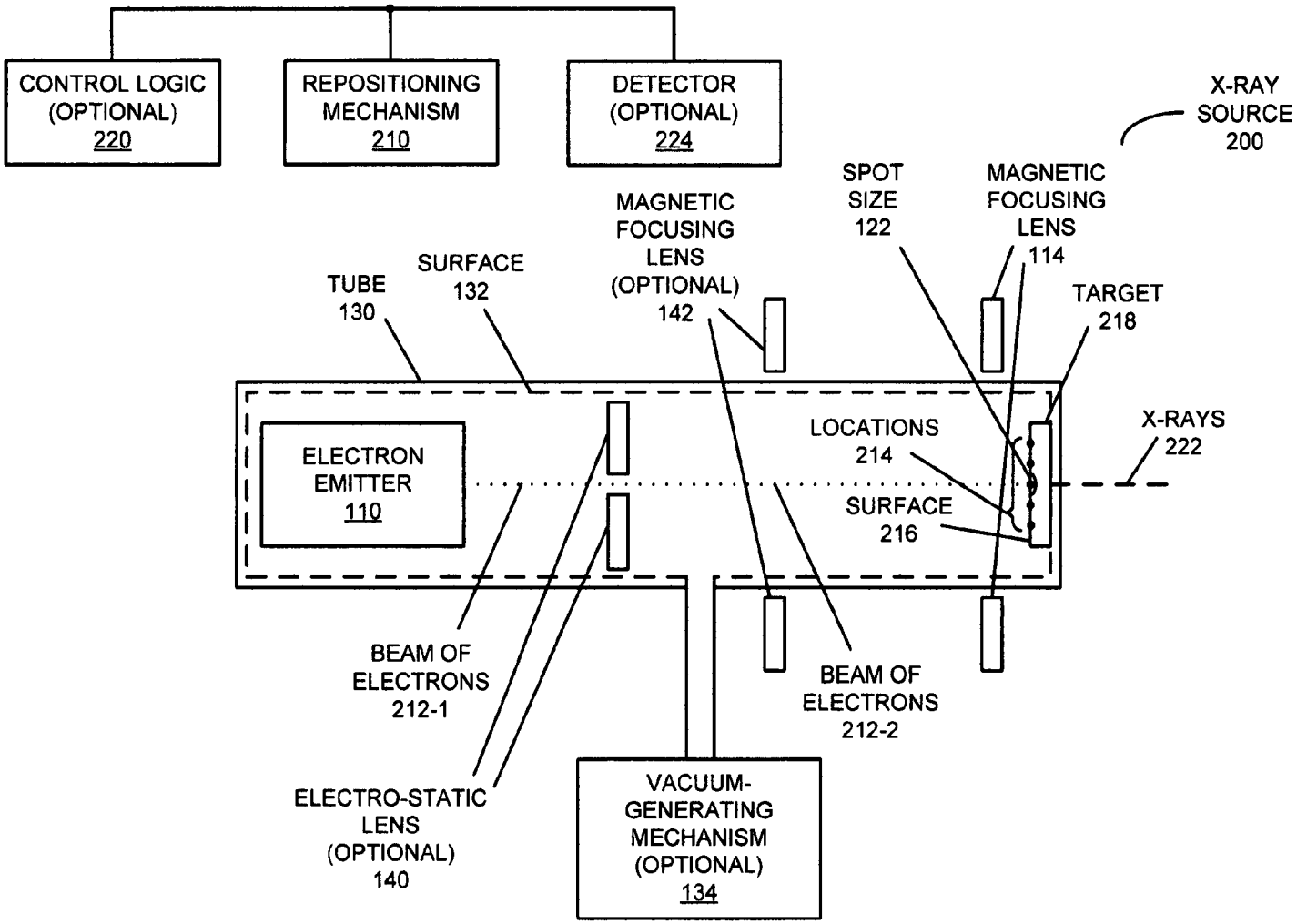
FIG. 2 is a block diagram of an x-ray source in accordance with an embodiment of the present disclosure.

A variety of techniques may be used to extend the operating life of the x-ray source and/or to improve its performance, for example, by controlling spot size 122. One feedback approach is illustrated in FIG. 2, which presents a block diagram of an x-ray source 200. (Note that, while not shown, x-ray source 200 may include additional components, such as at least some of those shown in FIG. 1.) In particular, x-ray source 200 may include a repositioning mechanism 210 that selectively reposition beam of electrons 212 to different locations 214 on a surface 216 of target 218 based on a feedback parameter associated with operation of x-ray source 200 (which may be provided by an optional detector 224). In some embodiments, locations 214 on surface 216 of target 218 may be predefined, such as a set of 100×100 locations in a 1 $mm^2$ area. Note that selectively repositioning beam of electrons 212 may extend an operating life of x-ray source 200 relative to another x-ray source in which the beam of electrons is approximately at a static location on the surface of the target during operation of the other x-ray source. In particular, selectively repositioning beam of electrons 212 to a fresh location on target 218 may eliminate burn out, thereby extending the operating life of the x-ray source up to 100,000 hours.

In some embodiments, the feedback parameter may be based on: an intensity of x-rays 222 output by x-ray source 200; a position of x-rays 222 output by x-ray source 200; a cross-sectional shape of x-rays 222 output by x-ray source 200; and/or a spot size of x-rays 222 out put by x-ray source 200. For example, if the intensity of x-rays 222 decreases (such as by 5, 10, 25 or 50%), beam of electrons 212 may be repositioned to a different location on surface 216.

Alternatively or additionally, the feedback parameter may include: a user input that specifies a different location on surface 216 of target 218 or that indicates a change in the location on surface 216 of target 218; an elapsed time, during operation of x-ray source 200, since the location on surface 216 of target 218 was last changed; when the x-ray source is transitioned from a low-power mode to an operating mode (i.e., the location on surface 216 may be moved each time x-ray source 200 is turned on); and/or a cumulative evaporation of target 218 at one or more locations on surface 216 of target 218 based on an energy density of beam of electrons 212 and the elapsed time, during operation of x-ray source 200, since the position of beam of electrons 212 on surface 216 of target 218 was last changed. For example, beam of electrons 212 may be moved every hour during operation of x-ray source 200. Note that optional control logic 220 may determine information (such an elapsed time) that is used by repositioning mechanism 210.

Figure 3:
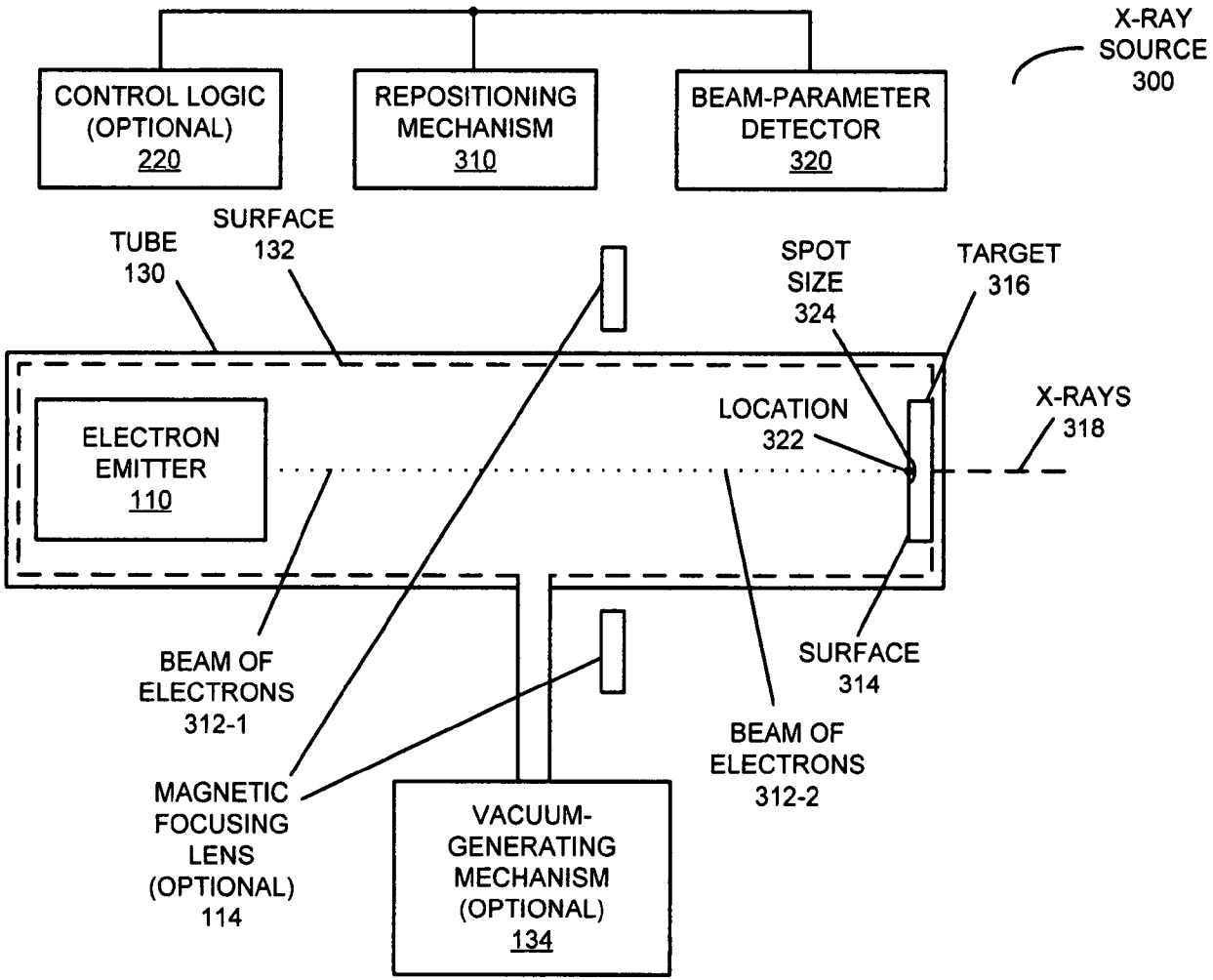
FIG. 3 is a block diagram of an x-ray source in accordance with an embodiment of the present disclosure.

Another feedback approach is illustrated in FIG. 3, presents a block diagram of an x-ray source 300. (Note that, while not shown, x-ray source 300 may include additional components, such as at least some of those shown in FIG. 1.) In this x-ray source, a repositioning mechanism 310 selectively repositions beam of electrons 312 on a surface 314 of a target 316 based on a feedback parameter, where a location 322 of beam of electrons 312 on surface 314 of target 316 defines a spot size 324 of x-rays 318 output by x-ray source 300. Then, in response to receiving beam of electrons 312, target 316 provides a transmission source of x-rays 318. Furthermore, a beam-parameter detector 320 provides the feedback parameter during operation of x-ray source 300 based on a physical characteristic associated with beam of electrons 312 and/or the x-rays 318 output by x-ray source 300.

Note that beam-parameter detector 320 may include: an optical detector, a secondary electron detector, a backscatter electron detector, an x-ray detector, and/or a current detector. Moreover, the physical characteristic may include: at least a portion of an infrared spectrum or a visible spectrum emitted by target 316 when it receives beam of electrons 312; secondary electrons emitted by target 316 based on a cross-sectional shape of beam of electrons 312; an intensity of x-rays 318 output by target 316; and/or a current from target 316.

In some embodiments, repositioning mechanism 310 scans beam of electrons 312 over target 316, where beam-parameter detector 320 includes an image sensor and the physical characteristic includes an image of target 316. For example, as described further below with reference to FIGS. 4A and 4B, the image sensor may image features on target 316 and, at a given time, repositioning mechanism 310 may approximately align beam of electrons 312 with a given one of the features. Alternatively or additionally, repositioning mechanism 310 may selectively vary a focus of beam of electrons 312 on target 316 based on the feedback parameter (thus, x-ray source 400 may auto-focus beam of electrons 312) and/or may adjust a cross-sectional shape of beam of electrons 312 based on the feedback parameter. In some embodiments, the adjustments may be based on predefined values, such as focus, deflection and/or stigmator corrections, that are stored in a data structure (for example, in a look-up table).

Figure 4A:
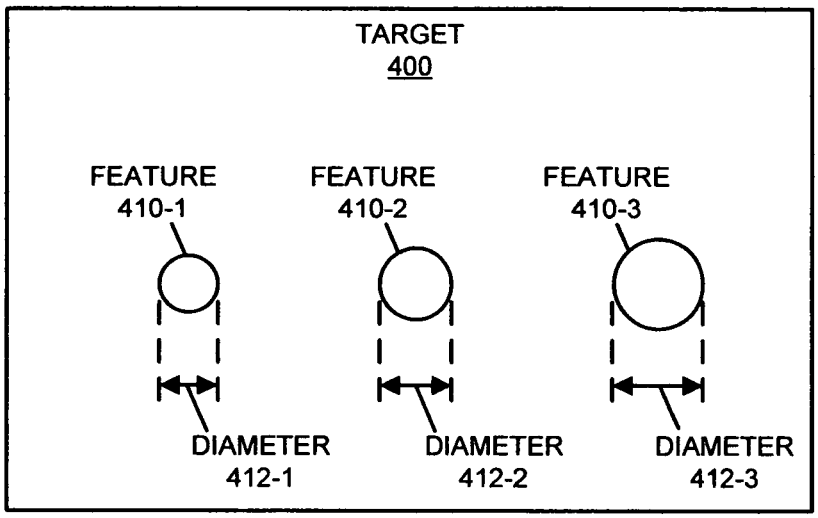
FIG. 4A is a block diagram illustrating a target in the x-ray source of FIG. 3 in accordance with an embodiment of the present disclosure.

Spot size 324 of x-rays 318 may be defined by target 316 independently of a cross-sectional shape of beam of electrons 312 received by target 316. Alternatively or additionally, x-ray source 300 may passively define spot size 324 based on location 322 of beam of electrons 312 on surface 314 of target 316. These embodiments are illustrated in FIG. 4A, which presents a block diagram illustrating a target 400 in x-ray source 300 (FIG. 3).

Figure 4B:
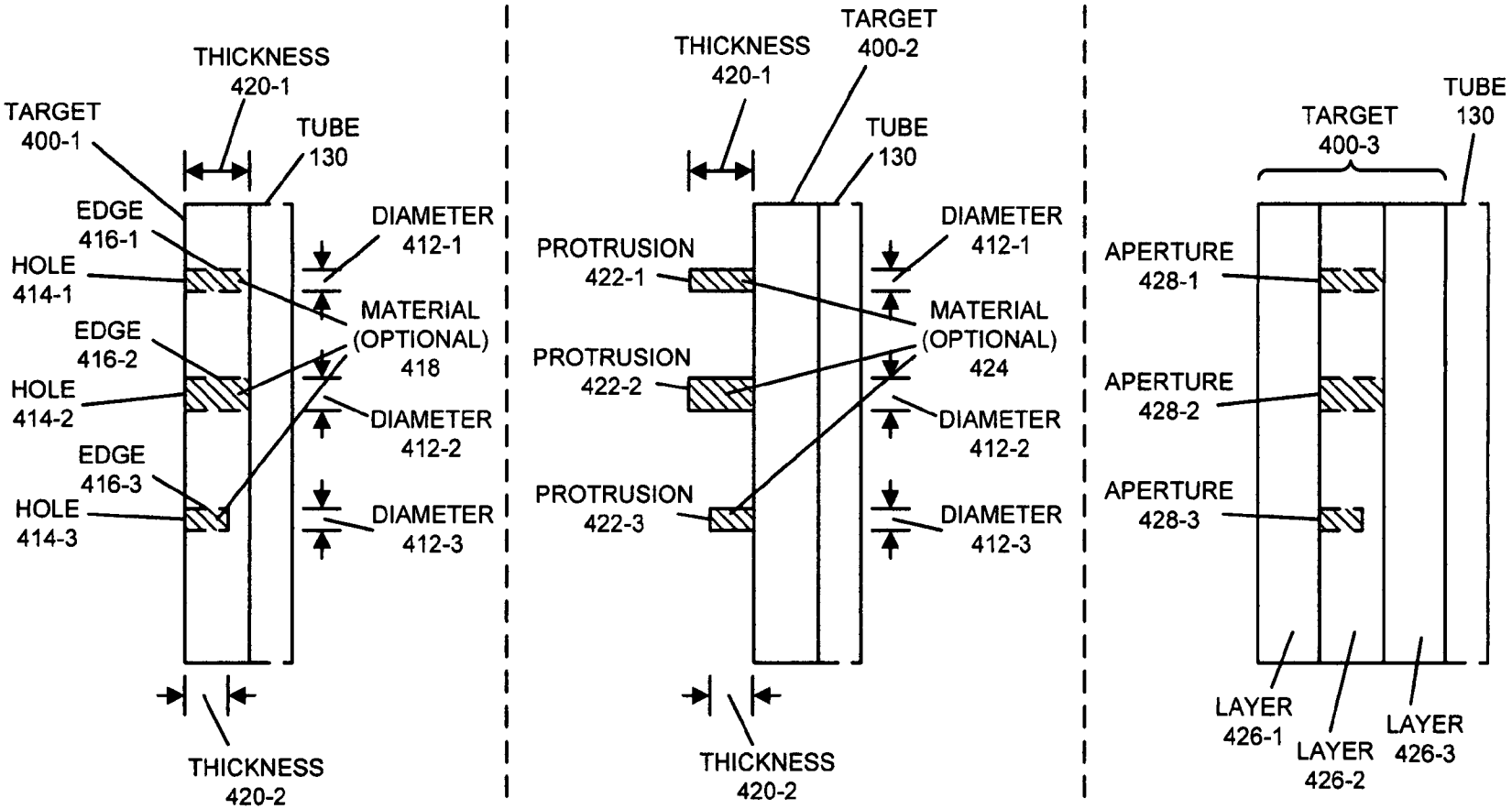
FIG. 4B is a block diagram illustrating side views of the target in FIG. 4A in accordance with an embodiment of the present disclosure.

In particular, target 400 may include features 410 having one or more cross-sectional diameters 412, where features 410 facilitate focusing beam of electrons 312 to spot size 324 in FIG. 3. For example, repositioning mechanism 310 (FIG. 3) may selectively reposition beam of electrons 312 (FIG. 3) towards one or more of features 410 based on a user input and/or the feedback parameter. As shown in FIG. 4B, which presents side views of the target, features 410 may include holes 414, defined by associated edges 416, in target 400-1. These holes may be, at least in part, filled with an optional material 418 (such as a refractory material or gold) that is other than a material of target 400-1 surrounding holes 414. Moreover, at least some of holes 414 may have different cross-sectional diameters 412 (FIG. 4A) and/or different thicknesses 420 (which may be used for different beam energies), thereby facilitating different spot sizes and different intensities of x-rays 318 output by x-ray source 300 depending on location 322 of beam of electrons 312 on surface 314 in FIG. 3.

In some embodiments, features 410 include protrusions 422 fabricated on the surface of target 400-2. These protrusions may include optional material 424 (such as a refractory material or gold), which is other than the material of target 400-2 surrounding protrusions 422. Moreover, at least some of protrusions 422 may have different cross-sectional diameters 412 and/or different thicknesses 420 (which may be used for different beam energies), thereby facilitating different spot sizes and different intensities of the x-rays 318 output by x-ray source 300 depending on location 322 of beam of electrons 312 on surface 314 in FIG. 3.

Moreover, target 400-3 may include multiple layers 426 in which at least one of the layers (such as layer 426-2) includes apertures 428 that reduce the initial spot size associated with beam of electrons 312 to spot size 324 of x-rays 318 output by x-ray source 300 in FIG. 3. For example, multiple layers 426 may include a layer 426-1 having an atomic number less than a predefined value (such as a 300 μm thick layer of diamond), a layer 426-2 that includes apertures 428, and a layer 426-3 having an atomic number greater than the predefined value (such as a 2 μm thick layer of tungsten). Furthermore, repositioning mechanism 310 (FIG. 3) may selectively reposition beam of electrons 312 (FIG. 3) towards one or more of apertures 428, thereby creating a well-defined beam of x-rays irrespective of the shape of beam of electrons 312.

Note that, in an exemplary embodiment, the cross-sectional diameter of one or more of features 410 is approximately 1 μm.

Referring back to FIG. 3, in some embodiments, x-ray source 300 includes an optional magnetic focusing lens 114 that focuses beam of electrons 312 to a spot, having the initial spot size, on target 316. In these embodiments, the feedback parameter may correspond to a difference between a cross-sectional diameter corresponding to the initial spot size of beam of electrons 312 and one or more cross-sectional diameter(s) 412 (FIG. 4B) of features 410 (FIGS. 4A and 4B) so that, when focused by optional magnetic focusing lens 114, the cross-sectional diameter corresponding to the spot size 324 of x-rays 318 approximately equals at least one of the cross-sectional diameter(s) 412 (FIG. 4B). Thus, during an auto-focus technique, beam of electrons 312 may be co-centrically aligned with one of features 410 (FIGS. 4A and 4B), and beam of electrons 312 may be focused until the cross-sectional diameter corresponding to spot size 324 approximately equals the cross-sectional diameter of this feature. However, in some embodiments, the cross-sectional diameter corresponding to spot size 324 is greater than the cross-sectional diameter of the feature, such as a 10 μm cross-sectional diameter of spot size 324 and a 1 μm cross-sectional diameter of the feature. This may allow an increased beam current to be used in the x-ray source.

Figure 5:
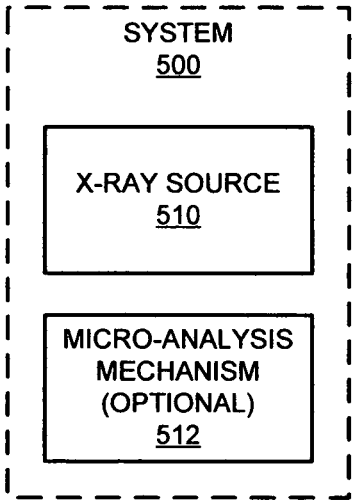
FIG. 5 is a block diagram of a system that includes an x-ray source in accordance with an embodiment of the present disclosure.

We now describe embodiments of the system. FIG. 5 presents a block diagram of a system 500 that includes an x-ray source 510, which may be one of the preceding embodiments of the x-ray source. For example, system 500 may be an x-ray point projection microscope and/or an x-ray imaging microscope. In the case of the x-ray point projection microscope, the resolution is, at least in part, determined by the spot size of the x-rays produced by x-ray source 510. In this regard, the reduced spot size associated with the preceding embodiments of the x-ray source may increase the resolution of the x-ray point projection microscope.

Moreover, x-ray source 510 may be used in conjunction with another micro-analysis technique, such as that provided at least in part by optional micro-analysis mechanism 512 (which may be a source, a detector and/or an analyzer), and which may share some of the same components as x-ray source 510 (such as control logic). For example, the other micro-analysis technique may include: energy dispersive x-ray analysis, optical imaging, optical microscopy, optical fluorescence imaging or spectroscopy, wavelength dispersive spectroscopy, x-ray diffraction analysis, x-ray fluorescence, electron microscopy and/or electron-beam backscattered diffraction. In some embodiments the source for the other micro-analysis technique may involve electron beam 112-1 (FIGS. 1-3), such as in: a scanning electron microscope (SEM), a transmission electron microscope (TEM), a scanning-transmission electron microscope (STEM), a low-energy electron microscope (LEEM), a secondary emission electron microscopes (SEEM), a mirror-electron microscope (MEM), and/or a variation on these types of microscopes.

While the present disclosure has been described in connection with specific embodiments, the claims are not limited to what is shown. Consequently, x-ray source 100 (FIG. 1), x-ray source 200 (FIG. 2), x-ray source 300 (FIG. 3), target 400 (FIGS. 4A and 4B) and/or system 500 may include fewer components or additional components. For example, the x-ray source may include multiple electron emitters, which may be implemented on an integrated circuit. Moreover, the x-ray source may include one or more optional electro-optical (EO) mechanism(s), which may be external to tube 130 (FIGS. 1-3), and which may scan, deflect, focus and/or stigmate the electron beam, such as: a magnetic deflection mechanism, a stigmator, a deflector and/or an alignment coil. Additionally, magnetic focusing lens 114 in FIG. 1 may combine a permanent magnetic lens and a 'tuning coil' to adjust the magnetic field strength to focus beam of electrons 112-1 into beam of electrons 112-2, and then onto target 124. This permanent magnet may supply at least 50% of the strength of the magnetic focusing field, thereby reducing the need for cooling (or temperature stabilizing) magnetic focusing lens 114. In turn, this may reduce the size of magnetic focusing lens 114, and may reduce the requirements for power-supply circuit 136.

While the preceding embodiments illustrated the x-ray source using a sealed tube, in other embodiments the tube is not sealed off from the external environment. In these embodiments and external vacuum-pumping mechanism (e.g., a multi-stage pump, a turbo-molecular pump, a diffusion pump, an ion pump, a cryopump, a sublimation pump and/or a getter pump) may be used to obtain a suitable vacuum at least during operation of the x-ray source.

Furthermore, two or more components may be combined into a single component and/or a position of one or more components may be changed. For example, components in these embodiments, such as beam-parameter detector 320 in FIG. 3, may be included in or external to tube 130 (FIGS. 1-3).

In the preceding embodiments, some components are shown directly connected to one another, while others are shown connected via intermediate components. In each instance the method of interconnection, or 'coupling,' establishes some desired electrical or mechanical functionality between two or more components in these devices. Such coupling may often be accomplished using a number of configurations, as will be understood by those of skill in the art, including adding additional intervening components and/or removing intervening components.

In some embodiments, functionality in these circuits, components and devices is implemented in hardware and/or in software as is known in the art. For example, some or all of the functionality of these embodiments may be implemented in one or more: application-specific integrated circuit (ASICs), field-programmable gate array (FPGAs), and/or one or more digital signal processors (DSPs). Additionally, a portion of the software (such as core functionality in an embedded operating system that prevents damage to the x-ray source) may be closed to users other than a manufacturer or supplier of the x-ray source, while another portion of the software (such as an application programming interface) may be 'open' to these users. In this way, an open-source community may generate user applications, which are stored on one or more computer-readable media, and which execute on or in conjunction with the x-ray source.

Furthermore, circuits in the preceding embodiments may be implemented using bipolar, PMOS and/or NMOS gates or transistors, and signals in these embodiments may include digital signals that have approximately discrete values and/or analog signals that have continuous values. Additionally, the circuits may be single-ended or differential, and/or may be multiplexed or use multiple connections.

Figure 6:
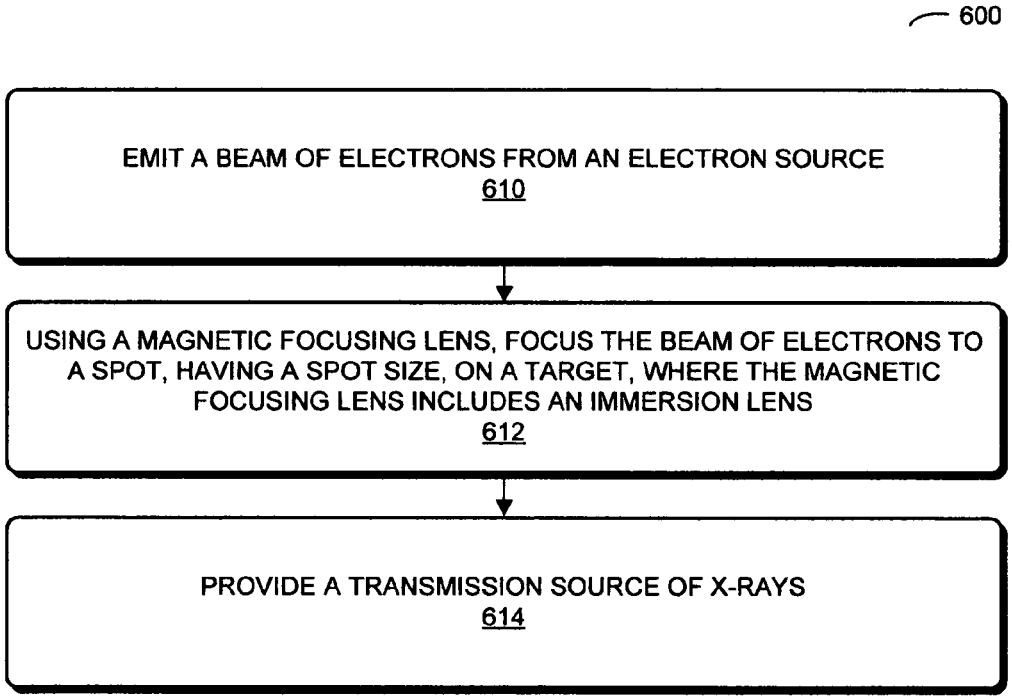
FIG. 6 is a flow diagram of a method for providing a transmission source of x-rays in accordance with an embodiment of the present disclosure.

We now describe embodiments of the method. FIG. 6 presents a flow diagram of a method 600 for providing a transmission source of x-rays, which may be performed by one of the preceding embodiments of the x-ray source. During this method, the beam of electrons is emitted from the electron source (operation 610). Then, using the magnetic focusing lens, the beam of electrons is focused to the spot, having the spot size, on the target (operation 612), where the magnetic focusing lens includes the immersion lens in which the peak in the magnitude of the magnetic field associated with the magnetic focusing lens occurs proximate to the plane of the target. Moreover, in response to receiving the beam of focused electrons at the target, the transmission source of x-rays is provided (operation 614).

Figure 7:
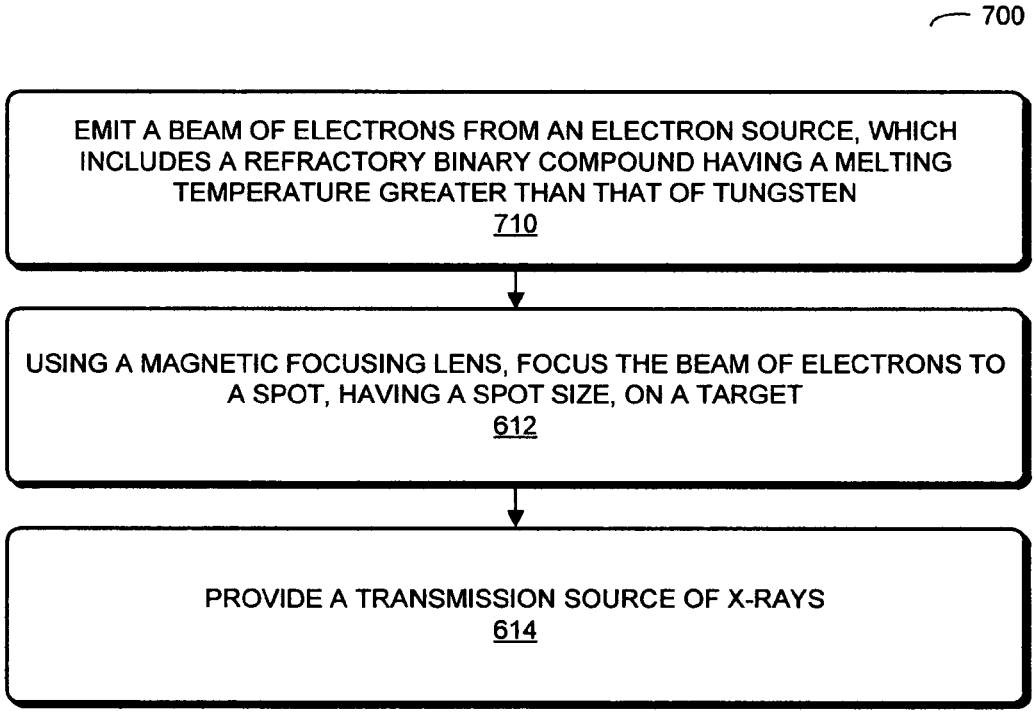
FIG. 7 is a flow diagram of a method for providing a transmission source of x-rays in accordance with an embodiment of the present disclosure.

FIG. 7 presents a flow diagram of a method 700 for providing a transmission source of x-rays, which may be performed by one of the preceding embodiments of the x-ray source. During this method, the beam of electrons is emitted from the electron source (operation 710), where the electron source includes the refractory binary compound having the melting temperature greater than that of tungsten. Then, using the magnetic focusing lens, the beam of electrons is focused to the spot, having the spot size, on the target (operation 612). Moreover, in response to receiving the beam of focused electrons at the target, the transmission source of x-rays is provided (operation 614).

Figure 8:
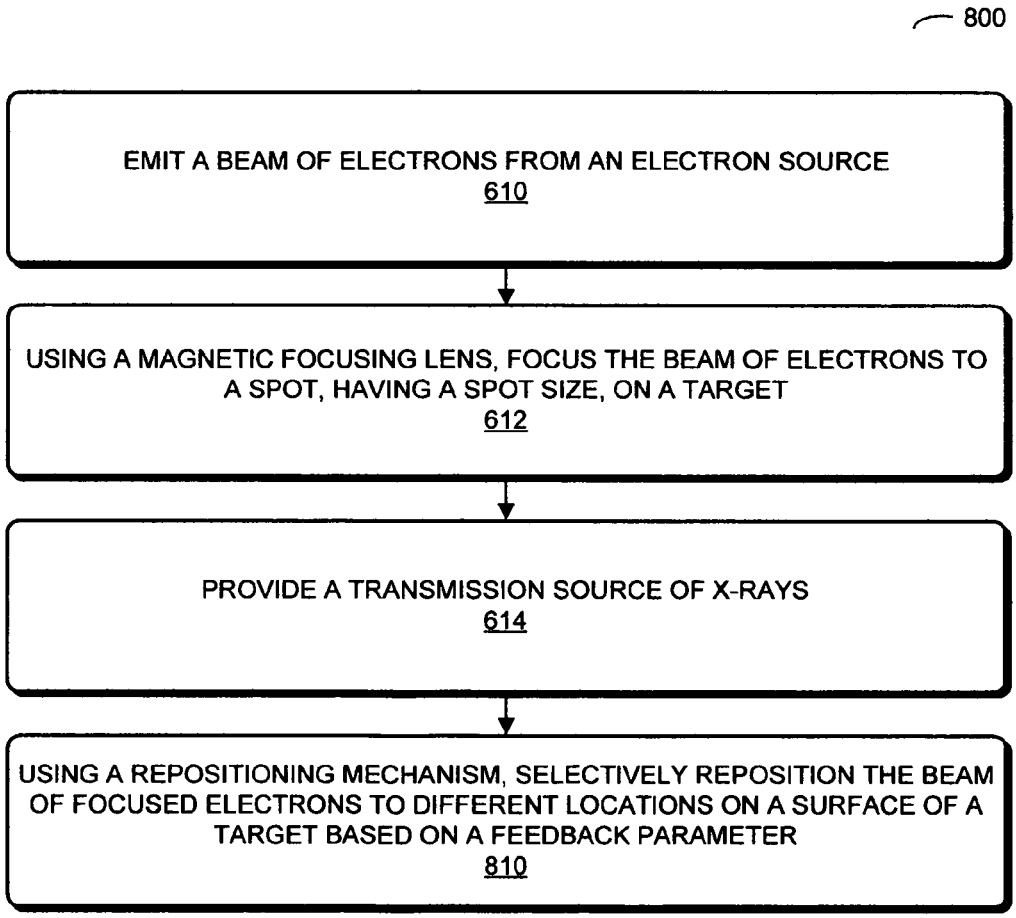
FIG. 8 is a flow diagram of a method for selectively repositioning a beam of focused electrons in an x-ray source in accordance with an embodiment of the present disclosure.

FIG. 8 presents a flow diagram of a method 800 for selectively repositioning a beam of focused electrons in an x-ray source, which may be performed by one of the preceding embodiments of the x-ray source. During this method, the beam of electrons is emitted from the electron source (operation 610). Then, using the magnetic focusing lens, the beam of electrons is focused to the spot, having the spot size, on the target (operation 612). Moreover, in response to receiving the beam of focused electrons at the target, the transmission source of x-rays is provided (operation 614). Next, the beam of focused electrons is selectively repositioned to different locations on the surface of the target using the repositioning mechanism based on the feedback parameter associated with operation of the x-ray source (operation 810).

Figure 9:
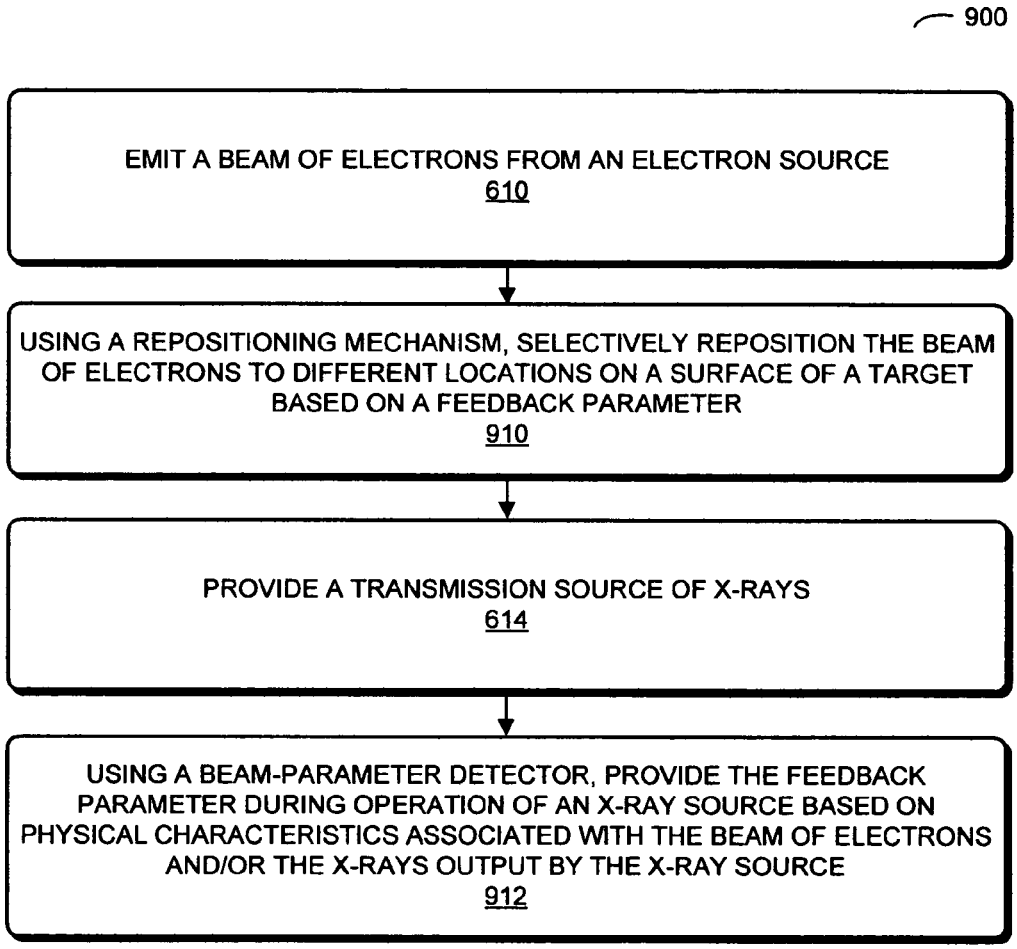
FIG. 9 is a flow diagram of a method for providing a feedback parameter in an x-ray source in accordance with an embodiment.

FIG. 9 presents a flow diagram of a method 900 for providing a feedback parameter in an x-ray source, which may be performed by one of the preceding embodiments of the x-ray source. During this method, the beam of electrons is emitted from the electron source (operation 610). Then, the beam of electrons is selectively repositioned to different locations on the surface of the target using the repositioning mechanism based on a feedback parameter (operation 910), where the location of the beam of electrons on the surface of the target defines the spot size of x-rays output by the x-ray source. In response to receiving the beam of electrons at the target, the transmission source of x-rays is provided (operation 614). Moreover, during operation of the x-ray source, the feedback parameter is provided using the beam-parameter detector based on the physical characteristic associated with the beam of electrons and/or the x-rays output by the x-ray source (operation 912).

In some embodiments, methods 600 (FIG. 6), 700 (FIG. 7), 800 (FIG. 8) and/or 900 include additional or fewer operations. Moreover, the order of the operations may be changed and/or two or more operations may be combined into a single operation.

Thus, the embodiments of the x-ray source may facilitate a wide variety of uses and applications. For example, the x-rays output by the preceding embodiments of the x-ray source may be used to irradiate an object, such as food or a parcel (or, more generally, an object that is shipped or mailed), thereby sterilizing the object, i.e., eliminating or reducing the presence of pathogens (such as bacteria or instances of a virus). Alternatively or additionally, the x-rays output by the preceding embodiments of the x-ray source may be used to inspect an object (such as an airplane, a train, a bridge, or in failure analysis of a machine that is susceptible to stress fractures or cracks) or to review features on the object (which may be identified via another technique). For example, the x-rays may be used to inspect or perform failure analysis on semiconductor dies or chips that include integrated circuits, as well as packages that include multiple semiconductor dies.

In some embodiments, the x-rays output by the preceding embodiments of the x-ray source is used to image or irradiate at least a portion of an animal (such as a patient or a biological sample associated with the patient), thereby performing a diagnostic test or implementing a medical therapy. For example, the x-rays may be used to performing an imaging study. In some embodiments, results of these measurements may be analyzed by software and/or hardware that is in or associated with the x-ray source to assist a healthcare provider (such as a physician). More generally, the x-ray source may be used to study biological samples, which may include wet biologic or in-vivo samples.

In some embodiments, the x-rays output by the preceding embodiments of the x-ray source is used to write patterns onto: a semiconductor wafer (such as silicon), a photo-mask, a MEMS substrate, a substrate for an optical device, and/or another substrate material during a lithographic process. For example, the photo-mask may include: a chromium-on-glass photo-mask, an alternating phase-shifting photo-mask, an attenuating phase-shifting photo-mask, a reflective photo-mask, and/or a multiple-exposure photo-mask (i.e., those where patterns printed using two or more photo-masks are combined to produce a desired pattern). Thus, the x-rays may be used to fabricate or repair the photo-mask. Furthermore, the lithographic process may include a direct-write lithographic process or a photo-lithographic process, including those with positive or negative photo-resist materials.

While the preceding examples illustrate several of the applications of the embodiments of the x-ray source, there are many additional applications, including in: the cosmetic industry, forensics, the pharmaceutical industry, biomedical applications, paper manufacturing, chemical manufacturing, steel manufacturing, the food industry, semiconductor fabrication, optics or photonics, and/or MEMS manufacturing and inspection. For example, the x-ray source may be integrated into process equipment, such as semiconductor fabrication equipment, including but not limited to: etching and deposition systems and/or metrology and inspection equipment. Alternatively or additionally, the x-ray source may be integrated with systems that utilize statistical process control (SPC) or factory automation. Furthermore, the improved resolution, performance and/or operating life of the preceding embodiments of the x-ray source may result in increased sales to businesses and in education, such as at schools.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein. Note that only those claims specifically reciting "means for" or "step for" should be construed in the manner required under the sixth paragraph of 35 U.S.C. §112.

What is claimed:

1. An x-ray source, comprising: an electron source configured to emit a beam of electrons; a target, and a repositioning mechanism configured to selectively reposition the beam of electrons on a surface of the target, the target configured to provide a transmission source of the x-rays in response to receiving the beam of electrons; wherein the target has holes in which at least some of the holes have different cross-sectional diameters, different thicknesses or both to facilitate different spot sizes and different intensities of the x-rays output by the x-ray source depending on the location of the beam of electrons on the surface of the target.

2. The x-ray source of claim 1, further comprising a beam-parameter detector configured to provide a feedback parameter used by the repositioning mechanism during operation of the x-ray source, the feedback parameter being based on a physical characteristic associated with the beam of electrons, the x-rays output by the x-ray source or both, wherein the beam-parameter detector includes at least one of: an optical detector, a secondary electron detector, a backscatter electron detector, an x-ray detector, and a current detector; and wherein the physical characteristic includes at least one of: at least a portion of an infrared spectrum or a visible spectrum emitted by the target when it receives the beam of electrons; secondary electrons emitted by the target based on a cross-sectional shape of the beam of electrons; an intensity of the x-rays output by the target; and a current from the target.

3. The x-ray source of claim 1, wherein the repositioning mechanism is configured to scan the beam of electrons over the target in response to feedback from an image sensor.

4. The x-ray source of claim 1, wherein the holes in the target facilitate focusing the beam of electrons to the spot size.

5. The x-ray source of claim 4, wherein the repositioning mechanism selectively repositions the beam of electrons towards one or more of the holes.

6. The x-ray source of claim 4, wherein the holes are defined by associated edges, in the target.

7. The x-ray source of claim 6, wherein the holes are, at least in part, filled with a refractory material that is other than a material of the target surrounding the holes.

8. The x-ray source of claim 1, wherein a spot size of the x-rays is defined by the target independently of a cross-sectional shape of the beam of electrons received by the target.

9. The x-ray source of claim 1, wherein the target includes multiple layers.

10. The x-ray source of claim 9, wherein the multiple layers include a first layer having an atomic number less than a predefined value, a second layer, and a third layer having an atomic number greater than the predefined value.

11. The x-ray source of claim 1, wherein the x-ray source passively defines a spot size of x-rays output by the x-ray source based on the location of the beam of electrons on the surface of the target.

12. The x-ray source of claim 1, wherein the repositioning mechanism is configured to selectively vary a focus of the beam of electrons on the target.

13. The x-ray source of claim 1, wherein the repositioning mechanism is configured to adjust a cross-sectional shape of the beam of electrons.

14. An x-ray comprising: an electron source configured to emit a beam of electrons; a target; and a repositioning mechanism configured to selectively reposition the beam of electrons on a surface of the target, which target is configured to provide a transmission source of the x-rays in response to receiving the beam of electrons and comprises protrusions fabricated in the surface of the target; wherein at least some of the protrusions have different cross-sectional diameters, different thicknesses or both, facilitating different spot sizes and different intensities of the x-rays output by the x-ray source depending on the location of the beam of electrons on the surface of the target.

15. The x-ray source of claim 14, wherein the protrusions include a refractory material other than a material of the target surrounding the protrusions.

16. An x-ray source, comprising: an electron source configured to emit a beam of electrons; a target; a repositioning mechanism configured to selectively reposition the beam of electrons on a surface of the target based on a feedback parameter, wherein a location of the beam of electrons on the surface of the target defines a spot size of x-rays output by the x-ray source and the target is configured to provide a transmission source of the x-rays in response to receiving the beam of electrons; a beam-parameter detector configured to provide the feedback parameter during operation of the x-ray source based on a physical characteristic associated with the beam of electrons, the x-rays output by the x-ray source or both; and a magnetic focusing lens configured to focus the beam of electrons to a spot, having an initial spot size, on the target; and wherein the feedback parameter corresponds to a difference between a cross-sectional diameter corresponding to the initial spot size of the focused beam of electrons and the cross-sectional diameter of the features so that, when focused by the magnetic focusing lens, the cross-sectional diameter corresponding to the spot size of the x-rays approximately equals the cross-sectional diameter.

17. A system, comprising an x-ray source, wherein the x-ray source includes: an electron source configured to emit a beam of electrons; a target; and a repositioning mechanism configured to selectively reposition the beam of electrons on a surface of the target based on a feedback parameter, wherein a location of the beam of electrons on the surface of the target defines a spot size of x-rays output by the x-ray source; the target configured to provide a transmission source of the x-rays in response to receiving the beam of electrons; and a beam-parameter detector configured to provide the feedback parameter during operation of the x-ray source based on a physical characteristic associated with the beam of electrons, the x-rays output by the x-ray source or both, wherein the target comprises protrusions or holes that have different cross-sectional diameters, different thicknesses or both to facilitate different spot sizes and different intensities of the x-rays output by the x-ray source depending on the location of the beam of electrons on the surface of the target.

18. A method for providing a feedback parameter, the method comprising: emitting a beam of electrons from an electron source; selectively repositioning the beam of electrons to different protrusions or holes that have different cross-sectional diameters, different thicknesses or both to facilitate different spot sizes and different intensities of the x-rays output by the x-ray source depending on the location of the beam of electrons on the surface of the target, the target; in response to receiving the beam of electrons, providing the transmission source of x-rays.

* * * * *